United States Patent [19]

Ueki et al.

[11] Patent Number: 4,749,074

[45] Date of Patent: Jun. 7, 1988

[54] COIN SORTING APPARATUS WITH REFERENCE VALUE CORRECTION SYSTEM

[75] Inventors: Toru Ueki, Gifu; Shigeru Kakimi, Inazawa, both of Japan

[73] Assignee: Matsushita Electric Industrial Co., Ltd., Osaka, Japan

[21] Appl. No.: 786,634

[22] Filed: Oct. 11, 1985

[51] Int. Cl.[4] ..... G07D 5/08; G07D 5/02

[52] U.S. Cl. ..... 194/317; 194/334; 194/335; 73/163

[58] Field of Search ..... 194/302, 303, 317, 318, 194/319, 320, 328, 334, 335; 324/227, 262, 236; 73/163; 133/3 R; 209/571, 567, 570; 364/579, 582

[56] References Cited

U.S. PATENT DOCUMENTS

| | | | |
|---|---|---|---|
| Re. 32,101 | 4/1986 | Ricciardi et al. | 222/58 X |
| 3,632,018 | 1/1972 | Ross | 222/1 |
| 3,991,605 | 11/1976 | Reuland | 209/535 X |
| 3,993,194 | 11/1976 | Reuland | 209/535 |
| 4,323,148 | 4/1982 | Nichimoto et al. | 194/321 |
| 4,538,719 | 9/1985 | Gray et al. | 194/317 |
| 4,572,349 | 2/1986 | Furuya et al. | 194/318 |

FOREIGN PATENT DOCUMENTS 8204204 12/1982 World Int. Prop. O. ..... 209/657

*Primary Examiner*—Joseph J. Rolla
*Assistant Examiner*—Edward S. Ammeen
*Attorney, Agent, or Firm*—Spencer & Frank

[57] ABSTRACT

A coin sorting apparatus in which the oscillation constants of oscillators change with the passage of a coin, and the amount of change in each of the oscillation constants or a value converted therefrom is compared with a reference value of a coin to be identified which is stored in a memory to identify whether the coin is genuine and the class thereof. Whether the reference values for each coin are corrected is determined by a plurality of counters which correct the reference values of corresponding classes of coins when their counts exceed a predetermined set value. At the same time, when the inserted coin is identified as genuine, a corresponding counter is activated, thus improving the performance of eliminating spurious coins without reducing the acceptability of genuine coins even under ambient temperature changes or secular variations of component elements with time.

8 Claims, 4 Drawing Sheets

FIG. 3
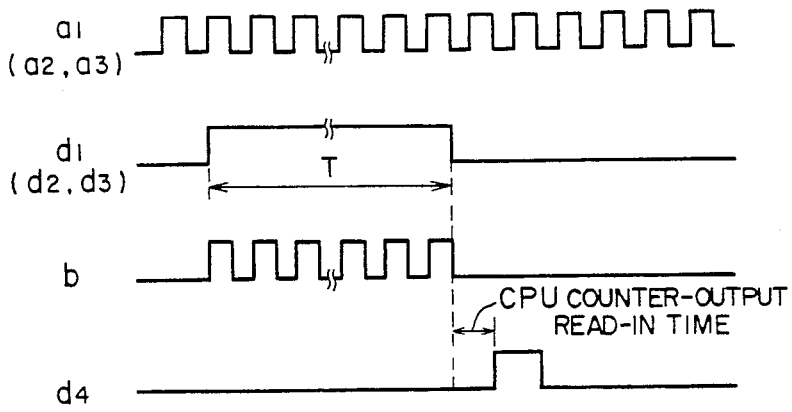
FIG. 4
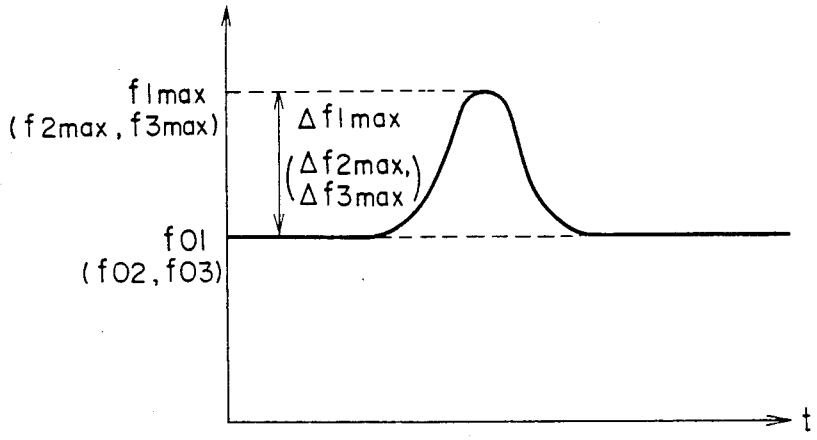
FIG. 5
| | DIAMETER REF VALUE | MATERIAL REF VALUE | THICKNESS REF VALUE |
|---|---|---|---|
| A COIN | f1 ( A ) | f2 ( A ) | f3 ( A ) |
| B COIN | f1 ( B ) | f2 ( B ) | f3 ( B ) |
| C COIN | f1 ( C ) | f2 ( C ) | f3 ( C ) |
| D COIN | f1 ( D ) | f2 ( D ) | f3 ( D ) |

FIG. 7

| COIN INSERTION TIMES | | INITIAL VALUE | 1 | 2 | 3 | 4 | | 5 | 6 | 7 | 8 | | ---- |
|---|---|---|---|---|---|---|---|---|---|---|---|---|---|
| MAX FREQUENCY CHANGE | Δf1max --- OUTSIDE DIA | | 118 | 117 | 118 | 118 | | 118 | 117 | 118 | 117 | | |
| | Δf2max --- MATERIAL | | 100 | 99 | 101 | 100 | | 100 | 99 | 100 | 100 | | |
| | Δf3max --- THICKNESS | | 81 | 82 | 82 | 81 | | 82 | 81 | 81 | 82 | | |
| CORRECTION COUNTER | C1 (A) --- OUTSIDE DIA | 8 | 7 | 6 | 5 | 4 | 8 | 7 | 6 | 5 | 4 | 8 | |
| | C2(A) --- MATERIAL | 8 | 8 | 7 | 8 | 8 | 8 | 8 | 7 | 7 | 7 | 7 | |
| | C3(A) --- THICKNESS | 8 | 9 | 10 | 11 | 12 | 8 | 9 | 9 | 9 | 10 | 10 | |
| REFERENCE VALUE | f1 (A) --- OUTSIDE DIA | 120 | → | → | → | → | 119 | → | → | → | → | 118 | |
| | f2 (A) --- MATERIAL | 100 | → | → | → | → | 100 | → | → | → | → | 100 | |
| | f3 (A) --- THICKNESS | 80 | → | → | → | → | 81 | → | → | → | → | 81 | |

COIN SORTING APPARATUS WITH REFERENCE VALUE CORRECTION SYSTEM

BACKGROUND OF THE INVENTION

1. Field of the Invention

The present invention relates to a coin checker or a coin sorting apparatus for electrically determining the genuineness or spuriousness and the class of a coins used with various vending machines.

2. Description of the Prior Art

An electronic coin-sorting apparatus comprises detection coils arranged as elements of oscillators distributed along a coin passage. With the approach of a coin to a detection coil, the impedance of the detection coil changes followed by a change in the oscillation constant, that is a change in the oscillation frequency or oscillation level of the associated oscillator. The change varies with sorting factors such as the outside diameter, thickness or material of the coin. By comparing the change with reference values stored in a memory in advance for various coins, it is possible to determine the genuineness or spuriousness and the denomination or class of the respective coins.

As an example, take the case where an A coin is identified by comparing the maximum change of the oscillation frequency with a reference value. Assume that the maximum changes of the oscillation frequencies of the outside-diameter detecting oscillator, material detecting oscillator and the thickness detecting oscillator for a coin inserted in the apparatus are $\Delta f_1 max$, $\Delta F_2 max$, $\Delta F_3 max$ respectively, and the reference values stored in advance for detection of the outside diameter, material and thickness of the A coin are $F_1(A)$, $F_2(A)$ and $F_3(A)$ respectively. If the inserted coin is to be identified as an A coin, it is necessary and sufficient to satisfy the three conditions specified below.

$f_1(A)-\alpha_A \leqq \Delta f_1 max \leqq f_1(A)+\alpha_{A'}$. . . for checking outside diameter $f_2(A)-\beta_A \leqq \Delta f_2 max \leqq f_2(A)+\beta_{A'}$. . . for checking material $f_3(A)-\gamma_A \leqq \Delta f_3 max \leqq f_3(A)+\gamma_{A'}$. . . for checking thickness where $\alpha_A$, $\alpha_{A'}$, $\beta_A$, $\beta_{A'}$, $\gamma_A$, $\gamma_A$, are constants to identify the inserted coin as an A coin if the maximum frequency changes of the inserted coin hold this relationship with the reference values thereof.

These constants are generally determined accumulatively according to the variations of the A coin, change in ambient temperature and secular variations of the component parts of the apparatus. The apparatus is so constructed that the A coin is rightly identified even when these factors change at the same time. If the performance to eliminate spurious coins is to be improved, however, these constants should be as small as possible. Nevertheless, a small value of a constant poses the problem that an actually-inserted A coin may not be identified under variations of the coin, changes in the ambient temperature or secular variations of the component parts of the apparatus, while if these constants are large, a spurious coin that may be inserted is likely to be identified as an A coin. In these days in which coins of high denominations are widely used, the cry or demand is especially high for an improved performance to eliminate spurious coins.

SUMMARY OF THE INVENTION

Accordingly, it is the object of the present invention to provide a coin sorting apparatus comprising a plurality of oscillators the oscillation constants of which change with the passage of a coin, a comparator for comparing the change in each of the oscillation constants or a value converted from such a change with a reference value of a coin to be identified which is stored in memory in advance to determine the genuineness or spuriousness and the class of the coin, a plurality of counters for determining whether the reference value of each class of coin should be corrected or not, each of the counters operating the correct the reference value of a coin when the set value for the coin is exceeded, and means for actuating a corresponding counter when an inserted coin is identified as a genuine coin, thereby improving the performance of the apparatus to eliminate spurious coins without reducing the acceptability of genuine coins under changes in ambient temperature or secular variations of the component parts of the apparatus.

BRIEF DESCRIPTION OF THE DRAWINGS

FIG. 3 is a time chart showing the manner in which the oscillation frequencies of oscillators are sampled.

FIG. 4 is a graph showing the changes in the oscillation frequencies with the passage of a coin along detection coils.

FIG. 5 shows a layout of reference value data in a memory.

FIG. 7 is a diagram showing an example of correction of a reference value.

DESCRIPTION OF THE PREFERRED EMBODIMENTS

Figure 1:
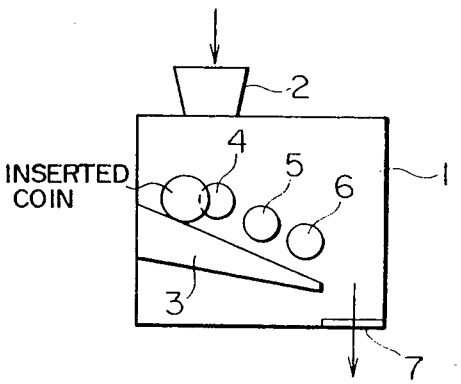
FIG. 1 is a schematic diagram showing a coin sorting apparatus.

In FIG. 1 showing an outline of a coin sorting apparatus, reference numeral 1 designates a coin sorting apparatus proper, numeral 2 a coin insertion port, numeral 3 a coin passage, numerals 4, 5, 6 coils for detection of the outside diameter, material and thickness of coins respectively, and numeral 7 a coin outlet.

Figure 2:
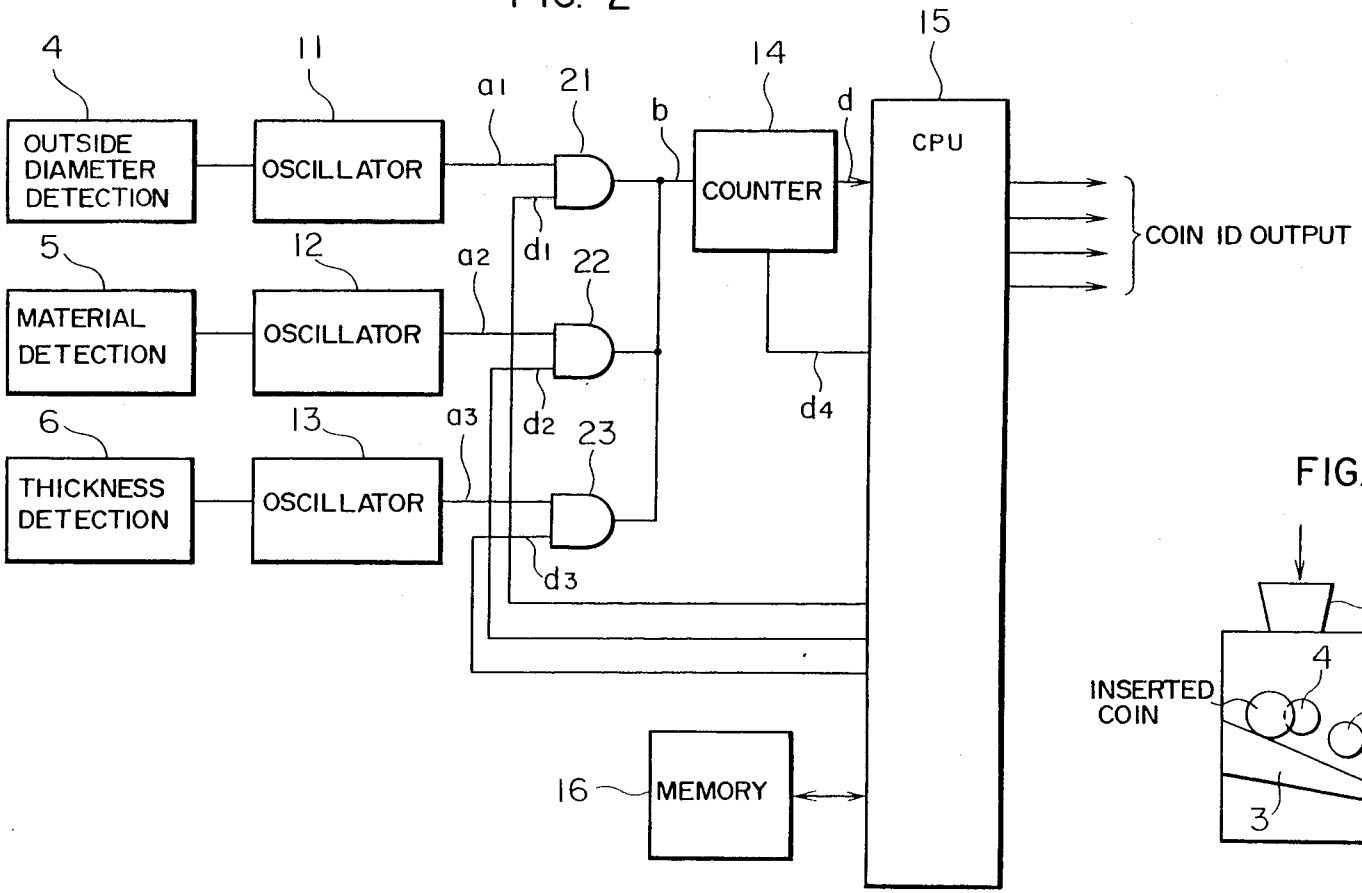
FIG. 2 is a diagram showing the internal configuration of a coin sorting apparatus.

The diagram of FIG. 2 shows the internal configuration of a coin sorting apparatus, in which numerals 11, 12, 13 designate oscillators connected with the outside diameter detection coil 4, the material detection coil 5 and the thickness detection coil 6 respectively each of the oscillators oscillating at a predetermined frequency. Numeral 14 designates a counter for counting the frequency produced from the oscillators 11 to 13 respectively, numeral 15 a central processing unit (CPU) in charge of general control including determination of the genuineness or spuriousness and the class of a coin and producing a judgement. Numeral 16 designates a random-access memory having stored therein the reference values of various coins.

A coin inserted by way of the insertion port 2 rolls along the coin passage 3, and when it approaches an outside diameter detection coil 4, the impedance of the detection coil 4 changes so that the oscillation frequency of the oscillator 11 changes. The oscillation output al of the oscillator 11 is applied through a gate 21 to the counter 14. FIG. 3 shows the relationship between the gate control signal d1 of the gate 21, the oscillation output al of the oscillator 11, the count input b of the counter 14, and the reset signal d4 for the counter 14. The oscillation output al of the oscillator 11 is applied as a count input b of the counter 14 for a predetermined time period T by a control signal d1 sent from the CPU 15 to the gate 21. In the meantime, the gate control signals d2, d3 of the gates 22, 23 fail to be produced, the gate 21 alone being enabled. The counter 14 counts the count input b and supplies the result of count d to the CPU 15. The CPU 15 produces the gate control signal d1 to the gate 21 for a predetermined period of time T, and then reads the count d. After reading the count d, the CPU 15 applies a reset signal d4 to the counter 14, so that the counter 14 is reset and restored to the initial state. In this way, the sampling processes of the oscillation frequency are repeated. Actually, the output time of the gate control signal d1 is set to 1 ms in such a manner that 500 pulses are applied to the count input b of the counter 14 when the oscillation output al of the oscillator 11 is 500 KHz.

The frequency change of the oscillation output a1 of the oscillator 11 with time as a coin passes the outside diameter detection coil 4 is shown in FIG. 4. It is possible to calculate the maximum amount of change $\Delta F_1max$ of the frequency representing the outside diameter of the inserted coin by sampling the oscillation frequency $f_{01}$ in the absence of a coin and the maximum frequency $F_1max$ with the coin passing the outside diameter detection coil 4. In similar manner, when the coin passes the material detection coil 5, the maximum amount of change $\Delta f_2max$ of the frequency of the oscillation output a2 of the oscillator 12 representing the material of the inserted coin is calculated. At the time of measurement of the frequency of the oscillation output of the oscillator 12, the gate control signals d1, d3 of the gates 21, 23 fail to be produced, the gate 22 alone being enabled. In similar fashion, when the inserted coin passes the material thickness detection coil 6, the maximum change $\Delta f_3max$ of the frequency of the oscillation output a3 of the oscillator 13 representing the thickness of the coin is calculated. At the time of measurement of the frequency of the oscillation output of the oscillator 13, the gate control signals d1, d2 of the gates 21, 22 fail to be produced, the gate 23 alone being enabled.

The values $\Delta f_1max$, $\Delta f_2max$, $\Delta f_3max$ of the inserted coin are thus determined, and respectively compared with the reference values of each coin stored in the memory 16 thereby to identify the genuineness or spuriousness and the class of the inserted coin. Assume, for example, that reference values of respective classes of coin (A, B, C and D coins) are stored in the memory 16 in the manner shown in FIG. 5. If the inserted coin is to be identified as an A coin, it is necessary and sufficient to satisfy the three conditions specified below as mentioned above.

$f_1(A)-\alpha_A \leqq \Delta f_1max \leqq f_1(A)+\alpha_{A'}$. . . Outside diameter determined $f_2(A)-\beta_A \leqq \Delta f_2max \leqq f_2(A)+\beta_{A'}$. . . Material determined $f_3(A)-\gamma]hd\ A \leqq \Delta f_3max \leqq f_3(A)+\gamma_{A'}$. . . Thickness determined where $\alpha_A$, $\alpha_A$, $\beta_A$, $\beta_{A'}$, $\gamma_A$, $\gamma_A$, are constants predetermined to take the variations of the A coin, the change of the ambient temperature with time, and the secular variations of the component parts, etc. into account also as mentioned above. In the case where the coin is not judged to be an A coin, the coin proceeds to be compared with the reference values of the B, C and D coins sequentially, and if there is no corresponding coin, the coin is judged as spurious. In accordance with the result of judgement, a coin identification signal is produced.

Figure 6:
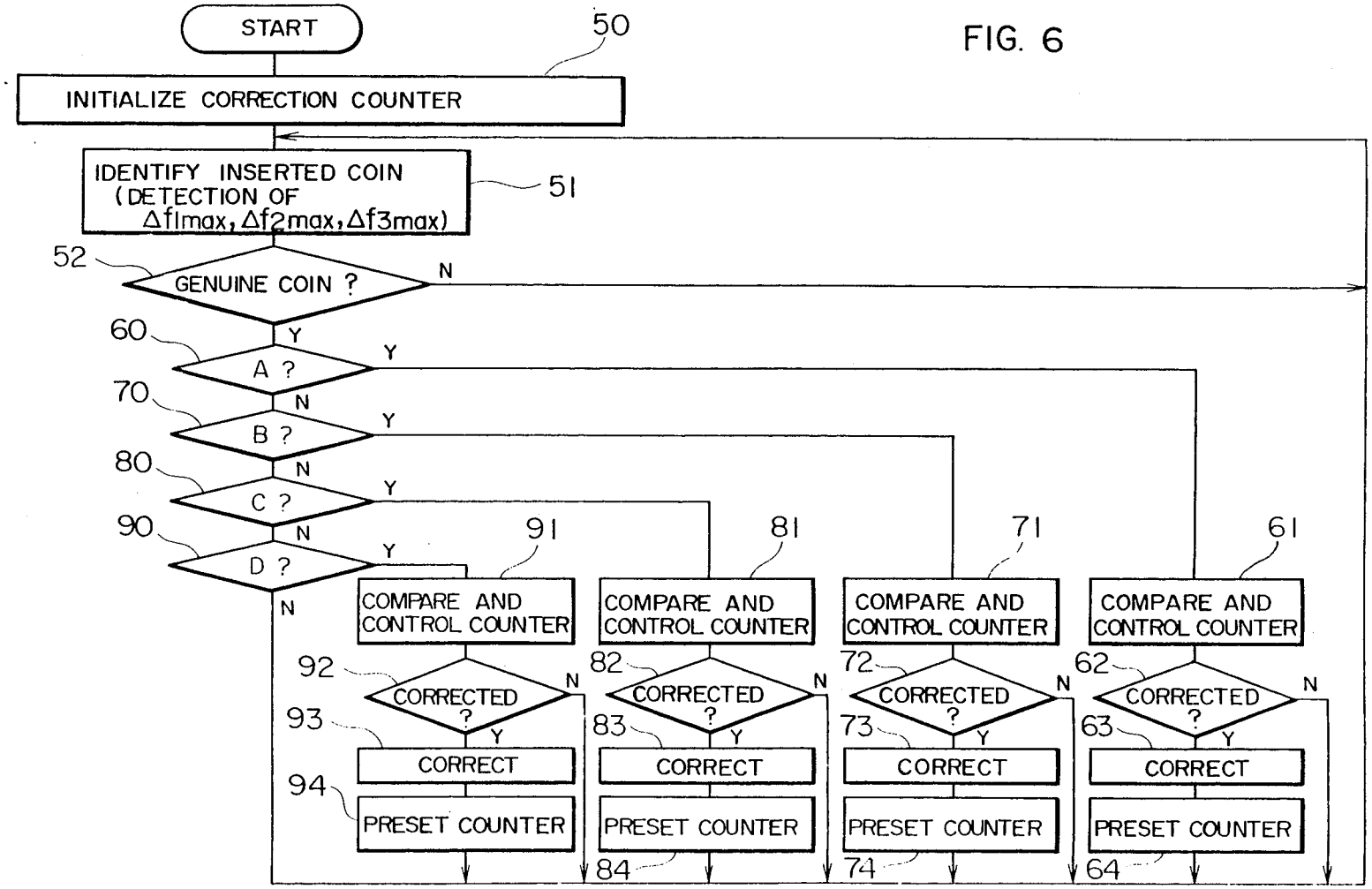
FIG. 6 is a flowchart showing procedures for correcting a reference value.

As aforementioned, if a coin is judged as genuine, the reference values involved are corrected through the procedures shown in FIG. 6.

First, step 50 presets a correction up-down counter for determining whether a reference value is to be corrected or not, to a certain value X. There are three such up-down counters related to the outside diameter, material and the thickness of a coin respectively as mentioned later. When the value of the correction counter is reduced below a certain value Y, the reference value is reduced by $-1$, while if the count of the correction counter is increased beyond a certain value Z, the reference value is increased by $+1$. The certain values X, Y and Z hold the relations $Y<X<Z$, and are actually set to 8, 4 and 12 respectively. Step 51 identifies the inserted coin in the above-mentioned method. If the coin identified at step 51 proves to be genuine at step 52, the process is passed to the correction routine of step 60 and subsequent steps, while if the coin is identified as spurious, the process is returned to step 51 for repeating the identification process.

Steps 60, 70, 80 and 90 determine the class of the coin identified as genuine at step 51, and according to the result thereof, the process is passed to steps 61, 71, 81 or 91 respectively. Step 61, 71, 81, 91 compare the maximum frequency change $\Delta f_1max$, $\Delta f_2max$, $\Delta f_3max$ determined at step 51 with each of the reference values of the respective coins, and if the reference value is larger, the corresponding correction counter is decreased by $-1$ while if the reference value is smaller, the correction counter is increased by $+1$. Step 62, 72, 82, 92 check the values of the counters processed at step 61, 71, 81, 91, and if the count of any correction counter is smaller than value Y or higher than Z, the process is passed to the next step 63, 73, 83, 93. Otherwise, the process is returned to step 51 for repeating the coin identification process. Step 63, 73, 83, 93 decrement the corresponding reference value by $-1$ if the count of a correction counter is below a certain value Y, while the reference value is incremented by $+1$ if the count of the correction counter is more than a certain value Z. Steps 64, 74, 84, 94 again preset to a certain value X the correction counters which have exceeded a certain value Z or decreased below a certain value Y, and the process is passed to step 51 for subsequent coin identification work.

The operations of step 52 and subsequent steps will be explained in detail again on the assumption that an inserted coin has been identified as class A.

Since the inserted coin is of class A, the process proceeds from step 52 to step 60 and to step 61. Step 61 compares the values $\Delta f_1max$, $\Delta f_2max$, $\Delta f_3max$ of the inserted coin with the reference values $f_1(A)$, $f_2(A)$, $f_3(A)$. If the relationship shown below holds, $f_1(A)>\Delta f_1max$ . . . Outside diameter
$f_2(A)=\Delta f_2max$ . . . Material $f_3(A) < \Delta f_3 max$ . . . Thickness the outside diameter counter $C_1(A)$, the material counter $C_2(A)$ and the thickness counter $C_3(A)$ of the A coin assume the states specified below.

$C_1(A) \leftarrow C_1(A) - 1$ . . . Outside diameter $C_2(A) \leftarrow C_2(A)$ . . . Material $C_3(A) \leftarrow C_3(A) + 1$ . . . Thickness After the counts of the counters $C_1(A)$, $C_2(A)$ and $C_3(A)$ are checked at step 62, assume that the following relations are found to hold, $Y < C_1(A) < Z$ . . . Outside diameter $Y < C_2(A) < Z$ ... Material $Y < C_3(A) < Z$ ... Thickness the process is returned to step 51.

If the following relationship is found to hold, on the other hand, $C_1(A) \leqq Y$ . . . Outside diameter $Y < C_2(A) < Z$ . . . Material $Z \leqq C_3(A)$ . . . Thickness the process is passed to step 63, where the reference values $f_1(A)$, $f_2(A)$, $f_3(A)$ for detection of the outside diameter, material and thickness respectively of the coin are corrected as below.

$f_1(A) \leftarrow f_1(A) - 1$ . . . Outside diameter $f_2(A) \leftarrow f_2(A)$ . . . Material $f_3(A) \leftarrow f_3(A) + 1$ . . . Thickness Step 64 sets the counters to the states as mentioned below respectively.

$C_1(A) \leftarrow X$ . . . Outside diameter $C_2(A) \leftarrow C_2(A)$ . . . Material $C_3(A) \leftarrow X$ . . . Thickness The counters $C_1(A)$, $C_3(A)$ corresponding to the reference values $f_1(A)$, $f_3(A)$ corrected are thus preset to a certain value X. In the process, the counter $C_2(A)$ for which the reference value is not corrected remains unchanged. The process is then returned for subsequent coin identification operation. The same correction procedures are prosecuted also for the B and C coins.

FIG. 7 shows the manner in which the reference values of the A coin are corrected when inserted coins are A coin. The constants are set as below.

$X=8$, $Y=4$, $Z=12$ $\alpha_A = \alpha_{A'} = 6$, $\beta_A = \beta_{A'} = 5$, $\gamma_A = \alpha_{A'} = 5$ The reference values are assumed to be initialized and set as $F_1(A)=120$, $f_2(A)=100$ and $F_3(A)=80$ respectively.

In the case of a first coin, $f_1(A) > \Delta f_1 max$ $(120 > 118)$ $f_2(A) = \Delta f_2 max$ $(100 = 100)$ $f_3(A) < \Delta f_3 max$ $(80 < 81)$ and therefore the counters assume the states specified below.

$C_1(A) \leftarrow C_1(A) - 1$ $(7 \leftarrow 8 - 1)$ $C_2(A) \leftarrow C_2(A)$ $(8 \leftarrow 8)$ $C_3(A) \leftarrow C_3(A) + 1$ $(9 \leftarrow 8 + 1)$ The counters $C_1(A)$, $C_2(A)$, $C_3(A)$ are operated in similar manner subsequently. The insertion of a fourth coin, the relationship holds that $C_1(A) \leqq 4$, $12 \leqq C_3(A)$ and therefore the reference values are corrected as shown below.

$f_1(A) \leftarrow f_1(A) - 1$ $(119 \leftarrow 120 - 1)$ $f_2(A) \leftarrow f_2(A)$ $(100 \leftarrow 100)$ $f_3(A) \leftarrow f_3(A) + 1$ $(81 \leftarrow 80 + 1)$ After correction, the counter $C_2(A)$ remains unchanged, while the counters $C_1(A)$ and $C_3(A)$ are preset to 8. Correction is also made after an eighth coin has been charged and it will be seen that the reference values $f_1(A)$, $f_2(A)$, $f_3(A)$ thus approach the average values of $\Delta f_1 max$, $\Delta f_2 max$, $\Delta f_3 max$ respectively as a result of the correction.

In this way, upon determination that a coin charged has been identified as genuine, the reference values of the coin are corrected. As a result of this, the effects of the changes in ambient temperature or secular variations of the component parts of the apparatus are eliminated, thereby narrowing the variation widths of the reference values for coin identification (this indicates that the values $\alpha_A$, $\alpha_{A'}$, $\beta_A$, $\beta_{A'}$, $\gamma_A$, $\gamma_{A'}$ can be reduced for the A coin, for instance).

In the case shown above, the passage of a coin causes changes in the oscillation frequencies of the oscillators, and these changes of the oscillation frequencies are used for identification of the coin. Instead, such data as a change in oscillation level as converted through an A/D converter or the like may be used and compared with reference values in the memory for coin identification. Also, the memory for storing the reference values of coins may take any form if it can read and write such as a RAM in a microprocessor or CPU. Further, in place of the reference values used above, the following two values may be used for the purpose of outside diameter detection in the case of an A coin, for instance:

1. $f_1(A) - \alpha_A$ Lower limit reference level
2. $f_1(A) + \alpha_A$ Upper limit reference level Furthermore, a reference value may be corrected in any of the manners mentioned below instead of by the method mentioned with reference to the embodiment explained above.

(1). Correction is made when the accumulation of the differences between the change for the genuine coins charged and a reference value reaches a certain value.

(2). In order to activate the correction means for those coins which have a small chance of being charged at the same time, correction is made not only for the class of coin charged but also for other classes of coin simultaneously. When the reference value of an A coin is incremented by +1, for instance, the counts of the counters for a class or two of coin are incremented by +1 at the same time.

(3). A switching function to determine whether or not to make a correction is provided for each of the identification factors including the outside diameter, material and thickness, in order to prevent correction for any identification factor which, if corrected, might have an adverse effect. In the case of outside diameter detection, for example, dust steadily deposited in the coin passage and the resultant increase in the reference value for outside diameter detection might prevent a genuine coin from being identified after removal of the dust. Therefore, the reference value for outside diameter is left uncorrected. The functions may be switched by an external switch or by bits in memory.

(4). A counter is provided for controlling the amount of correction of the reference value set at the time of production in order to prevent correction beyond a certain level. In such a case as mentioned in (3) above in which a correction for the outside diameter may have an adverse effect, for example, the control counter is adjusted to ±1 at the time of correction of a reference value, so that when the counter value exceeds a certain value or is decreased below a certain value, correction is not made subsequently, thus enabling the apparatus to accept a genuine coin normally even after removal of deposited dust.

Other applications and modifications of the present invention may of course be included in the present invention to the extent that they are easily conceivable from the embodiments mentioned above.

It will thus be understood from the foregoing detailed description that according to the present invention the reference values for each class of coin stored in advance in memory are corrected successively by genuine coins charged in the apparatus, and therefore the effects of the change in ambient temperature or secular variations of the components parts of the apparatus which occur at a slow rate are eliminated, thus improving the performance of removing spurious coins without reducing the acceptability of genuine coins.

We claim:

1. In a coin sorting apparatus for determining whether coins of different kinds passed therethrough are genuine, said apparatus comprising a plurality of oscillators each generating a signal having a value which varies in accordance with the characteristics of a coin passing through said apparatus, and a memory wherein a plurality of preset reference values are stored for each kind of coin, the improvement comprising:

a plurality of up-down counters for each kind of coin, one of said up-down counters being provided for each of said plurality of preset reference values for each kind of coin;

first means for detecting if the value of each of the signals generated by said plurality of oscillators is above or below a corresponding preset reference value, said first means operating the up-down counter corresponding to said preset reference value to count up or count down from an initial value in accordance with the value of said oscillator signal relative to said corresponding preset reference value; and second means for detecting whether the count of said corresponding up-down counter is above a respective predetermined upper count limit or below a respective predetermined lower count limit, said second means incremeting or decrementing the corresponding reference value to correct said reference value in accordance with said detected count.

2. An apparatus according to claim 1 wherein said first means operates said up-down counter to count up or count down in increments of one count, and wherein said predetermined upper and lower count limits are greater than one count.

3. In connection with a coin sorting apparatus for determining whether coins of different kinds passed therethrough are genuine, said apparatus comprising a plurality of oscillators each generating a signal having a value which varies in accordance with the characteristics of a coin passing through said apparatus, and a memory wherein a plurality of preset reference values are stored for each kind of coin, the method comprising the steps of:

detecting whether the value of each of the signals generated by said plurality of oscillators is above or below a corresponding preset reference value;

operating an up-down counter corresponding to one of said plurality of preset reference values to count up or count down from an initial value in accordance with the value of one of the signals generated by said plurality of oscillators relative to said corresponding preset reference value;

detecting whether the count of said corresponding up-down counter is above a respective predetermined upper count limit or below a respective predetermined lower count limit; and incrementing or decrementing the corresponding reference value to correct said reference value in accordance with said detected count.

4. The method of claim 3 wherein said up-down counter is operated to count up or count down in increments of one count, and wherein said predetermined upper and lower limits are greater than one count.

5. In a coin sorting apparatus for determining whether a coin passing therethrough having denomination and given sorting factors is genuine, said coin sorting apparatus including at least one oscillator having an oscillation constant which changes when a coin passes through said apparatus, means for measuring the change in said oscillation constant and means for comparing said measured oscillation constant change with a preset reference value corresponding to the denomination and at least one of the sorting factors of said coin, the improvement comprising:

at least one up-down counter, each of said counters, being provided for a corresponding reference value for making, said comparison;

first means for detecting whether said measured oscillation constant change is above or below said corresponding one of said reference values, said first means operating the counter which corresponds to said one corresponding reference value to count up or count down from an initial value in accordance with the detected direction of said measured change; and second means for detecting whether the counter corresponding to said one corresponding reference value counts above a predetermined upper count limit or below a predetermined lower count limit, said second means correcting by incrementing or decrementing the corresponding reference value in response to the detected count.

6. An apparatus according to claim 5, including means for operating the respective up-down counters in response to the sorting of any inserted coin as a genuine coin.

7. An apparatus according to claim 5, including means for presetting upper and lower reference values for comparison with the measured values.

8. A coin sorting apparatus for determining whether a coin passing therethrough having a denomination and given sorting factors such as outer diameter, material and thickness is genuine, said coin sorting apparatus including a plurality of oscillators each having an oscillation constant which changes when a coin passes through said apparatus, means for measuring the change in the oscillation constant of each said oscillator with the passage of a coin and means for comparing each measured oscillation constant change with respective preset reference values corresponding to at least two of said sorting factors for each denomination of coin, the improvement comprising:

means for identifying the denomination of each coin passing through said apparatus by comparing at least one measured change sequentially with each of said respective reference values corresponding to one of said at least two sorting factors;

a plurality of up-down counters, each of said counters being provided for a corresponding reference value for making said comparison;

first means for detecting whether each of said measured oscillation constant changes is above or below each one of said corresponding reference values, said first means operating the counter which corresponds to said one corresponding reference value to count up or count down from an initial value in accordance with the detected direction of said measured change; and second means for detecting whether the counter corresponding to said one corresponding reference value counts above a predetermined upper count limit or below a predetermined lower count limit, said second means correcting by incrementing or decrementing the corresponding reference value in response to the detected count, said second means further including comparison means for comparing the count of the respective counter with the respective predetermined limits to determine whether the corresponding reference value should be corrected.

* * * * *